US006081781A

United States Patent [19]

Tanaka et al.

[11] Patent Number: 6,081,781

[45] Date of Patent: Jun. 27, 2000

[54] METHOD AND APPARATUS FOR SPEECH SYNTHESIS AND PROGRAM RECORDED MEDIUM

[75] Inventors: Kimihito Tanaka; Masanobu Abe, both of Yokohama, Japan

[73] Assignee: Nippon Telegragh and Telephone Corporation, Tokyo, Japan

[21] Appl. No.: 08/926,037

[22] Filed: Sep. 9, 1997

[30] Foreign Application Priority Data

Sep. 11, 1996 [JP] Japan ..... 8-240350

[51] Int. Cl.[7] ..... G10L 13/02

[52] U.S. Cl. ..... 704/268; 704/269

[58] Field of Search ..... 704/203, 205, 704/207, 220, 222, 230, 260, 268, 269, 267, 221, 270, 272

[56] References Cited

U.S. PATENT DOCUMENTS

| | | | |
|---|---|---|---|
| 5,077,798 | 12/1991 | Ichikawa et al. | 704/222 |
| 5,151,968 | 9/1992 | Tanaka et al. | 704/222 |
| 5,231,671 | 7/1993 | Gibson et al. | 704/205 |
| 5,327,521 | 7/1994 | Savic et al. | 704/272 |
| 5,384,891 | 1/1995 | Asakawa et al. | 704/220 |
| 5,428,708 | 6/1995 | Gibson et al. | 704/270 |
| 5,641,926 | 6/1997 | Gibson et al. | 84/603 |
| 5,717,819 | 2/1998 | Emeott et al. | 704/221 |
| 5,740,320 | 4/1998 | Itoh | 704/267 |
| 5,745,650 | 4/1998 | Otsuka et al. | 704/260 |

OTHER PUBLICATIONS

Asakawa et al., "A 2.4 KBPS speech coding method based on fuzzy vector quantization," 1990 International Conference on Acoustics, Speech, and Signal Processing, vol. 2, pp. 673–676, Apr. 1990.

Asakawa et al., "Speech coding method using fuzzy vector quantization," 1989 International Conference on Acoustics, Speech, and Signal Processing, vol. 2, pp. 755–758, Apr. 1989.

Tanaka, K. and Abe, M., "A New Fundamental Frequency Modification Algorithm with Transformation of Spectrum Envelope According to $F_0$," IEEE International Conference on Acoustics, Speech, and Signal Processing, vol. 2, Apr. 21–24, 1997, pp. 951–954.

Valbret, H., et al., "Voice Transformation using PSOLA Technique," *Speech Communication,* vol. 11, Nos. 2/3, Jun. 1992, pp. 175–187.

(List continued on next page.)

*Primary Examiner*—David R. Hudspeth
*Assistant Examiner*—Martin Lerner
*Attorney, Agent, or Firm*—Pollock, Vande Sande & Amernick

[57] ABSTRACT

Data in the same range of the fundamental frequency $F_0$ as speech segments are used as learning data to prepare a reference codebook $CB_M$ for a spectrum envelope. The same learning data for a higher range than $F_0$ and the same learning data for a lower range are subject to a linear stretch matching with respect to the learning data for the range $F_0$. For each vector code in the reference codebook $CB_M$, the spectrum envelope is clustered to prepare a high range codebook $CB_H$ and a low range codebook $CB_L$. The spectrum envelope of input speech segments are fuzzy vector quantized (S402) with the reference codebook, and depending on the synthesized $F_0$, a high, middle or low codebooks is selected. The selected codebook is used to decode the fuzzy vector quantized code, and the decoded output is subject to the inverse FFT. Alternatively, codebooks $CM_{MH}$ and $CB_{ML}$ each comprising differential vectors for corresponding code vectors between $CB_M$ and $CB_H$ and between $CB_M$ and $CB_L$ are prepared. The quantized code is decoded using either $CB_{MH}$ or $CB_{ML}$, and the decoded differential vector is stretched in accordance with a difference in the fundamental frequency between the synthesized speech and the original speech for $CB_M$. The stretched differential vector is added to the code vector which was used for the fuzzy vector quantization.

23 Claims, 8 Drawing Sheets

OTHER PUBLICATIONS

Abe, M., et al., "Voice Conversion Through Vector Quantization," IEEE International Conference on Acoustics, Speech, and Signal Processing, vol. 1, Apr. 11–14, 1998, pp. 655–658.

Shikano, K., et al., "Speaker Adaptation and Voice Conversion by Codebook Mapping," IEEE International Symposium on Circuits and Systems, vol. 1, Jun. 11–14, 1991, pp. 594–597.

Yoshida, Y., and Abe, M., "An Algorithm to Reconstruct Wideband Speech from Narrowband Speech Based on Codebook Mapping," Proceedings of the International Conference on Spoken Language Processing, Sep. 18, 1994, pp. 1591–1594.

Matsumoto, H. and Inoue, H., "A Minimum Distortion Spectral Mapping Applied to Voice Quality Conversion," Proceedings of the International Conference on Spoken Language Processing, Nov. 18, 1990, pp. 161–164.

METHOD AND APPARATUS FOR SPEECH SYNTHESIS AND PROGRAM RECORDED MEDIUM

BACKGROUND OF THE INVENTION

The invention relates to a speech synthesis method which is intended to prevent a quality degradation of synthesized speech which occurs when the fundamental frequency pattern of a speech produced significantly deviates from a pattern of speech segments during conversion from a text into a speech using speech segments, and which is also intended to prevent a quality degradation of synthesized speech which occurs when producing synthesized speech which significantly deviates from the fundamental frequency pattern of an original speech during the analysis and synthesis of speech.

In the prior art practice, the transformation from a text into a speech takes place by cutting out a waveform for one period from a pre-recorded speech segment every fundamental period, and rearranging the waveform in conformity to a fundamental frequency pattern which is produced from a result of analysis of the text. This technique is referred to as PSOLA technique, which is disclosed, for example, in M. Moulines et al. "Pitch-synchronous waveform, processing techniques for text-to-speech synthesis using diphones" Speech Communication, vol. 9, pp. 453–467 (1990-12).

In the analysis and systhesis, an original speech is analyzed to retain spectral features, which are utilized to synthesize the original speech.

In the prior art practice, the quality of synthesized speech is markedly degraded if the fundamental frequency pattern of a speech which is desired to be synthesized significantly deviates from the fundamental frequency pattern exhibited by a pre-recorded speech segment. For detail, refer T. Hirokawa et al. "Segment Selection and Pitch Modification for High Quality Speech Synthesis using Waveform Segments" ICSLP90, pp. 337–340, D. H. Klatt et al. "Analysis, synthesis, and perception of voice quality variations among female and male talkers" J. Acoust. Soc. Am. 87(2), February 1990, pp. 820–857. Accordingly, in the conventional PSOLA technique, if the waveform is rearranged directly in conformity to the fundamental frequency pattern produced as a result of analysis of the text, a substantial quality degradation may result, and resort had to be had to a flat waveform which exhibits a minimal variation in the fundamental frequency pattern.

It is considered that a quality degradation of synthesized speech which results from largely changing the fundamental frequency of a speech segment is caused by an acoustical mismatch between the fundamental frequency and the spectrum. Thus synthesized speech of good quality can be obtained by providing many speech segments having a spectral structure which matches well with the fundamental frequency. However, it is difficult to utter every speech segment at its desired fundamental frequency, and if this is possible, the required storage capacity will become voluminous, and its implementation will be prohibitive.

In view of this, Japanese Laid-Open Patent Application No. 171,398 (laid open Oct. 21, 1982) proposes that spectrum envelope parameter values for a plurality of voices having different fundamental frequencies are stored for each vocal sound, and a spectrum envelope parameter for the closest fundamental frequency is chosen for use. This involves a drawback that the quality improvement is minimal because of a reduced number of available fundamental frequencies, and the storage capacity becomes voluminous.

In Japanese Laid-Open Patent Application No. 104,795/95 (laid open Apr. 21, 1995), a human voice is modelled to prepare a conversion rule, and the spectrum is modified as the fundamental frequency changes. With this technique, the voice modelling is not always accurate, and accordingly, the conversion rule cannot properly match the human voice, foreclosing an expectation for better quality.

A modification of the fundamental frequency and the spectrum for purpose of speech synthesis is proposed in Assembly of Lecture Manuscripts, pp. 337 to 338, in a meeting held March 1996 by the Acoustical Society of Japan. The proposal is directed to a rough transformation of spreading an interval in a spectrum as the fundamental frequency $F_0$ increases, and cannot provide synthesized speech of good quality.

In the analysis and synthesis, there remains a problem of a quality degradation of synthesized speech when the synthesized speech to be produced has a pitch periodicity which significantly differs from the pitch periodicity of an original speech.

It is to be noted that the present invention has been published in part or in whole by the present inventors at times later than the claimed priority date of the present Application in the following institutes and associations and their associated journals:

A. Kimihiko Tanaka, and Masanobu Abe, "A New Fundamental Frequency Modification Algorithm With Transformation of Spectrum Envelope According to F0", 1997 International Conference on Acoustics, Speech, and Signal Processing (ICASSP 97) Vol. II, pp. 951–954, The Institute of Electronics Engineers (IEEE) Signal Processing Society, Apr. 21–24, 1997.

B. Kimihiko Tanaka and Masanobu Abe, "Text Speech Synthesis System Modifying Spectrum Envelope in accordance with Fundamental Frequency", Institute of Electronics, Information and Communication of Japan, Research Report Vol. 96, No. 566, pp. 23–30, SP96-130, Mar. 7, 1997 (published on 6th). Corporation: Institute of Electronics, Information and Communication of Japan.

C. Kimihiko Tanaka and Masanobu Abe, "Speech Synthesis Technique Modifying Spectrum Envelope according to F0", in Assembly of Lecture Manuscripts I, pp. 217–218, for 1997 Spring Meeting of Acoustical Society of Japan held on Mar. 17, 1997. Corporation: Acoustical Society of Japan.

D. Domestic Divulgation and Assembly of Manuscripts Kimihiko Tanaka and Masanobu Abe, "Speech Synthesis Technique Modifying Spectrum Envelope according to Fundamental Frequency", in Assembly of Lecture Manuscripts |, pp. 217–218, for 1996 Autumn Meeting of Acoustical Society of Japan held on Sep. 25, 1996. Corporation: Acoustical Association of Japan.

SUMMARY OF THE INVENTION

To solve the problems mentioned above, in accordance with the invention, a modification is applied to the spectrum envelope in accordance with a difference of the fundamental frequency of a speech to be synthesized over the fundamental frequency of an input speech, thus a speech segment or an original speech, by utilizing a relationship between the spectrum envelope of a natural speech and the fundamental frequency.

Learning speech data is prepared by uttering a common text in several ranges of the fundamental frequency, for example. A codebook is then prepared from this data for each range of the fundamental frequency. Between the ranges of the fundamental frequency, code vectors have a one-to-one correspondence in these codebooks. When synthesizing a speech, a speech feature quantity contained in the spectrum envelope which is extracted from an input speech is vector quantized using a codebook (a reference codebook) for the range of the fundamental frequency to which the input speech belongs, and is decoded on a mapping codebook of the range of the fundamental frequency in which the synthesis is desired, thus modifying the spectrum envelope. The modified spectrum envelope achieves an acoustical match between the fundamental frequency and the spectrum, and thus can be used to achieve a speech synthesis with a high quality.

Differential vectors between corresponding code vectors in the reference codebook and codebooks for other ranges of the fundamental frequency are derived to prepare differential vector codebooks. Then, differences in the mean values of the fundamental frequencies of element vectors which belong to corresponding classes in the reference codebook and codebooks for other ranges of the fundamental frequency are derived to prepare frequency difference codebooks. The spectrum envelope of the input speech is vector quantized with the reference codebook, and differential vector which corresponds to the resulting quantized code is determined from the differential vector codebook. The frequency difference which corresponds to the quantized code is determined from the frequency difference codebook, and on the basis of the frequency difference, the fundamental frequency of the input speech and a desired fundamental frequency, a stretching rate which depends on the difference between the both fundamental frequencies is determined. The differential vector is stretched in accordance with the stretching rate thus determined, and the stretched differential vector is added to the spectrum envelope of the input speech. By transforming the spectrum envelope which results from the addition into the time domain, there is obtained a speech segment having its spectrum envelope modified. In this manner, a modification of the spectrum envelope which matches an arbitrary fundamental frequency, that is different from a range of the fundamental frequency in which the codebook is prepared, is enabled.

DESCRIPTION OF PREFERRED EMBODIMENTS

Figure 1:
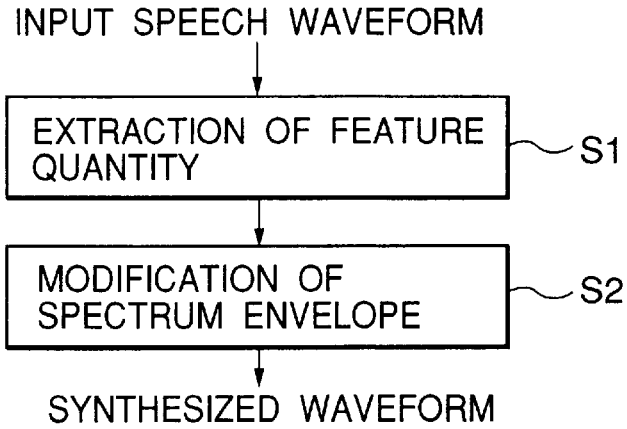
FIG. 1 depicts a basic procedure representing the principle of the invention.

FIG. 1 shows a basic procedure of the invention. At step S1, a spectrum feature quantity is extracted from an input speech. At step S2, a modification is applied to the spectrum envelope of the input speech by utilizing a relationship between the fundamental frequency and the spectrum envelope and in accordance with a difference in the fundamental frequency between the input speech and a synthesized speech, thus yielding a synthesized speech.

In the description to follow, several embodiments of the invention as applied to the text-to-speech synthesis will be described. In a text-to-speech system which utilizes a speech segment, an input text is analyzed to provide a series of speech segments which are used in the synthesis and a fundamental frequency pattern. Where the fundamental frequency pattern of a speech being synthesized deviates significantly from the fundamental frequency pattern which the speech segments exhibit inherently, a modification is applied to the spectrum envelope of the speech segments in accordance with the invention in a manner dependent on the magnitude of a deviation of the fundamental frequency pattern of the speech segments from a given fundamental frequency pattern. To apply such a modification, a spectrum feature quantity of a speech segment or an input speech waveform is extracted, in a manner illustrated in FIG. 2. It is to be understood that speech data used herein contain pitch marks which represent a boundary of phonemes and a fundamental period thereof.

Figure 2:
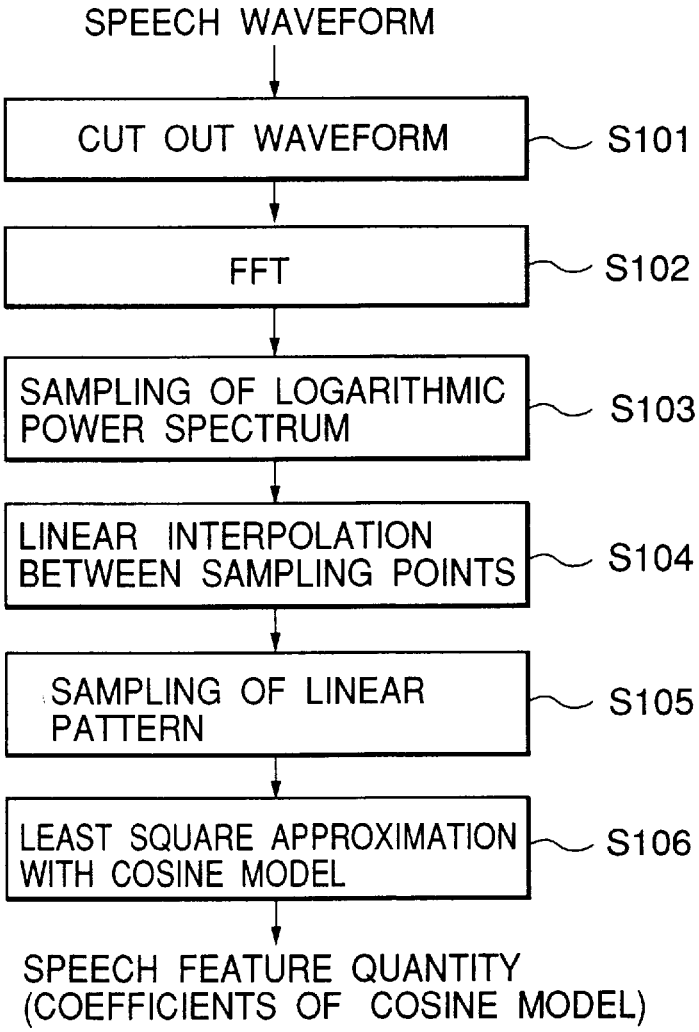
FIG. 2 is a flowchart of an algorithm which is used according to the invention to extract a spectrum envelope from a speech waveform.

FIG. 2 illustrates a procedure of extracting a speech feature quantity representing spectrum envelope information which efficiently denotes a speech signal. The procedure shown is an improvement of a technique in which a logarithmic spectrum is sampled for a maximum value located adjacent to an integral multiple of the fundamental frequency and the spectrum envelope is estimated by the least square approximation of the cosine model (see H. Matsumoto et al. "A Minimum Distortion Spectral Mapping Applied to Voice Quality Conversion" ICSLP 90, 5, 9, pp. 161–194 (1990)).

When a speech waveform is input, a window function centered about a pitch mark and having a length equal to five times the fundamental period, for example, is applied thereto, thus cutting out a waveform at step S101.

At step S102, the waveform cut out is subject to FFT (fast Fourier transform) to derive a logarithmic power spectrum.

Figure 3:
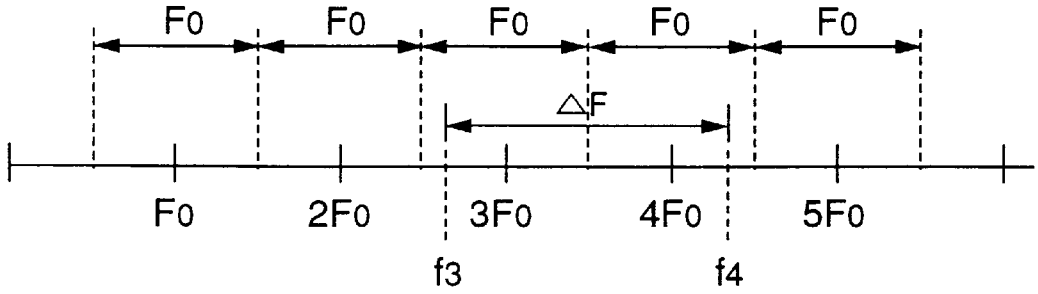
FIG. 3 is a diagram illustrating a sampling point having a maximum value according to the algorithm shown in FIG. 2.

At step S103, the logarithmic power spectrum obtained at step S102 is sampled for a maximum value which is located adjacent to an integral multiple of the fundamental frequency $F_0$ ($nF_0-F_0/2<f_n<nF_0+F_0/2$) where n represents an integer. Thus, referring to FIG. 3, a maximum value of the respective power spectrum is extracted in each section centered about the frequency of $F_0$, $2F_0$, $3F_0$ . . . , respectively. For example, if the frequency $f_3$ of the maximum value extracted in the section centered about $3F_0$ is below $3F_0$, if the frequency $f_4$ of the maximum value extracted in the adjacent section centered about $4F_0$ is above $4F_0$ and if the difference $\Delta F$ between $f_3$ and $f_4$ or the interval between adjacent samplings is greater than 1.5 $F_0$, a local maximum value in the logarithmic power spectrum is also sampled in the section defined between $f_3$ and $f_4$.

At step S104, sampling points determined at step S103 are linearly interpolated.

At step S105, the linearly interpolated pattern obtained at step S104 is sampled at a maximum interval $F_0/m$ which satisfies $F_0/m<50$ Hz where m represents an interger.

At step S106, the sampling points of step S105 are least square approximated by a cosine model indicated by an equation (1) given below.

$$Y(\lambda)=\Sigma^{M}_{i=1}A_i \cos i\lambda, \ (0\leqq\lambda\leqq\pi) \quad (1)$$

A speech feature quantity (cepstrum) $A_i$ is given by the equation (1). The described manner of extracting the speech feature quantity faithfully represents the peak in the power spectrum, and is referred to as IPSE technique.

An algorithm for preparing codebooks in different ranges of the fundamental frequency which are used in the modification of the spectrum envelope will now be described with reference to FIG. 5. As an example, the choice of three ranges of the fundamental frequency, which are "high", "middle" and "low", will be considered. Speech data (learning speech data) which is used as an input is one obtained when a single speaker utters a common text in three ranges of the fundamental frequency.

Figure 5:
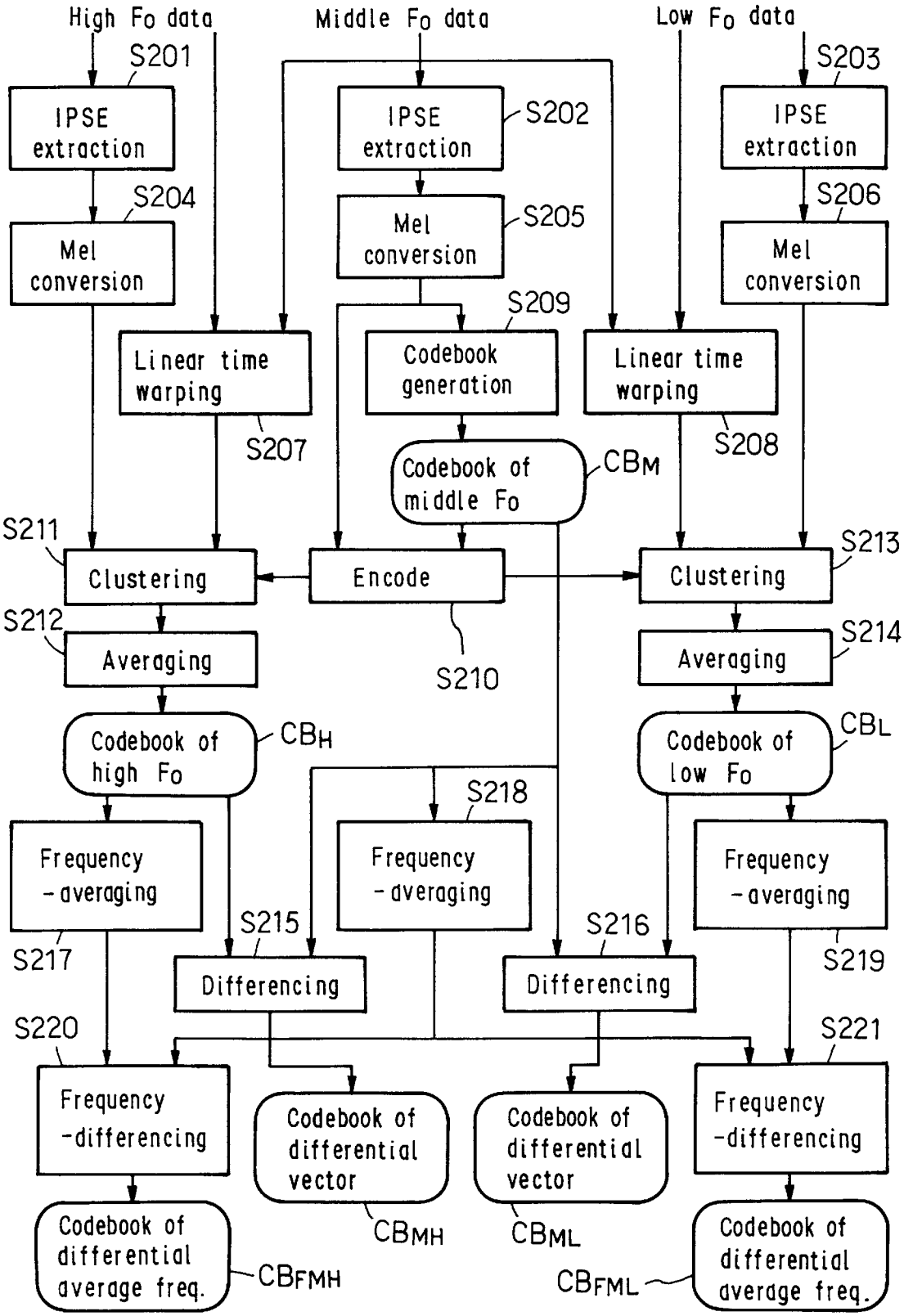
FIG. 5 is a flowchart of a procedure for preparing three mapping codebooks which are previously assembled into a text speech synthesis system in an embodiment of the invention.

Referring to FIG. 5, speech feature quantities, which are IPSE cepstrums in the present example, are extracted for every pitch mark from respective speech data for "high", "middle" and "low" ranges of the fundamental frequency according to the algorithm shown in FIG. 2 at steps S201, S202 and S203, respectively.

IPSE cepstrums extracted at steps S201, S202 and S203 are subject to Mel conversion at steps S204, S205 and S206, respectively, where frequency scale is converted into Mel scale to provide Mel IPSE cepstrums in order to improve the auditory response. For detail of Mel scale, refer to "Computation of Spectra with Unequal Resolution Using the Fast Fouriser Transform" Proceeding of The IEEE February 1971, pp. 299–301, for example.

Figure 4:
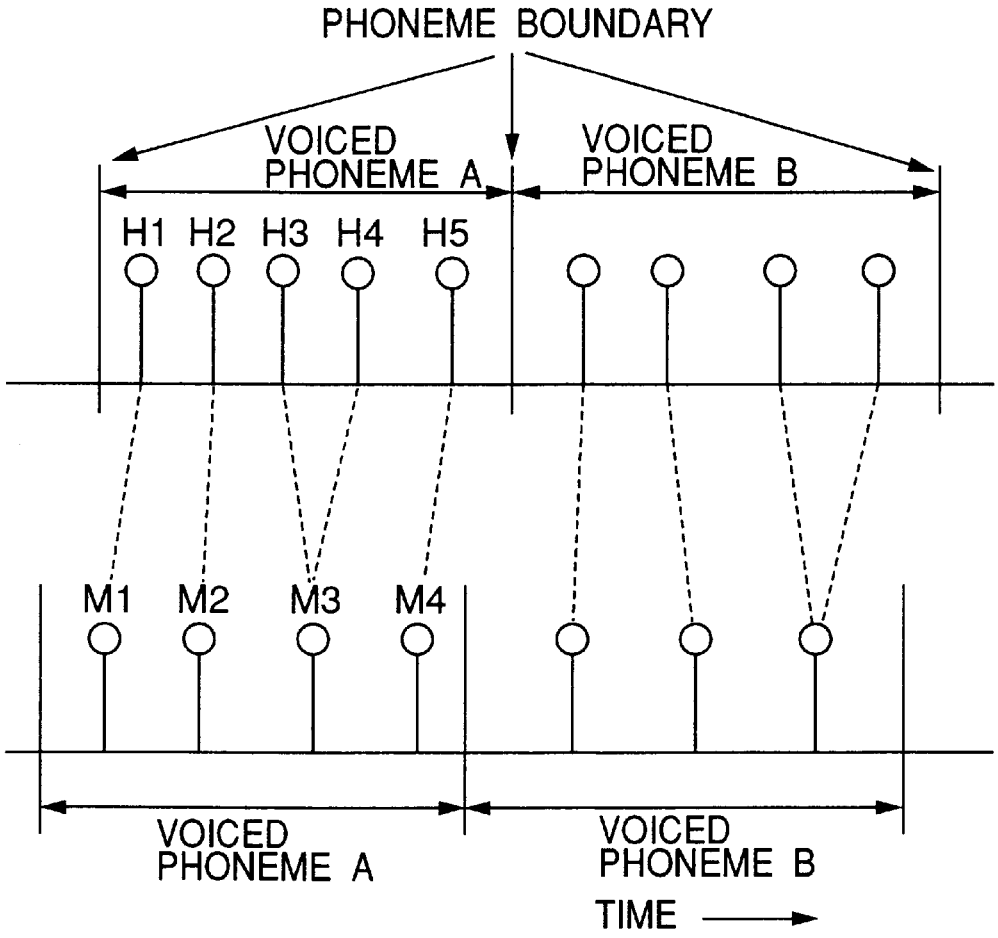
FIG. 4 is a diagram illustrating a correspondence between pitch marks which occur between speech data in different ranges of the fundamental frequency.

At step S207, a linear stretch matching takes place for every voiced phoneme between a train of pitch marks in the speech data for the "high" range of the fundamental frequency and a train of pitch marks in the speech data for the "middle" range of the fundamental frequency for the common text in a manner illustrated in FIG. 4, thus determining a correspondence between the pitch marks of both ranges. Specifically, assuming that the train of pitch marks in the speech data for the "high" range of the fundamental frequency of a voiced phoneme A comprises H1, H2, H3, H4 and H5 while the train of pitch marks in the speech data for the "middle" range of the fundamental frequency comprises M1, M2, M3 and M4, a correspondence is established between H1 and M1, between H2 and M2, between H3 and H4 and M3 and between H5 and M4. In this manner, pitch marks in corresponding phoneme sections of both "high" and "middle" ranges of the fundamental frequency are brought into correspondence relationship between closely located ones in the respective section by linearly stretching the time axis. Similarly, a correspondence relationship is established between pitch marks in the speech data for the "low" and "middle" ranges of the fundamental frequency at step S208.

At step S209, speech feature quantity (Mel IPSE cepstrum) extracted for every pitch mark from the speech data for the "middle" range of the fundamental frequency is clustered according to an LBG algorithm, thus preparing a codebook CBM for the "middle" range of the fundamental frequency. For detail of the LBG algorithm, see Linde et al. "An Algorithm for Vector Quantization Design," (IEEE COM-28 (1980-01), pp. 84–95), for example.

At step S210, using the codebook for the "middle" range of the fundamental frequency which is prepared at step S209, Mel IPSE cepstrum for the "middle" range of the fundamental frequency is vector quantized. That is, a cluster is determined to which Mel IPSE cepstrum for the "middle" range belongs.

At step S211, by utilizing the result of correspondence relationship established at step S207 between pitch marks in the speech data for both the "high" and the "middle" range of the fundamental frequency, each speech feature quantity (Mel IPSE cepstrum) extracted from the speech data for the "high" range of the fundamental frequency and which corresponds to each code vector in the codebook prepared at step S209 is made to belong to the class of the code vector. Specifically, a feature quantity (Mel IPSE cepstrum) at pitch mark H1 (FIG. 4) of the voiced phoneme A is made to belong to the class of a code vector number in which a feature quantity (Mel IPSE cepstrum) at pitch mark M1 is quantized. Similarly, a feature quantity at H2 is made to belong to the class of a code vector number in which a feature quantity at M2 is quantized. Respective feature quantities at H3 and H4 are made to belong to the class of a code vector number in which a feature quantity at M3 is quantized. A feature quantity at H5 is made to belong to the class of a code vector number in which a feature quantity at M4 is quantized. In this similar manner, respective feature quantity (Mel IPSE cepstrum) for the "high" range of the fundamental frequency is classified into the code vector number in which a corresponding feature quantity (Mel IPSE cepstrum) for the "middle" range of the fundamental frequency is quantized. A clustering of feature quantities (Mel IPSE cepstrums) in the speech data for the "high" range of the fundamental frequency takes place in this manner.

At step S212, a barycenter vector (a mean) of feature quantities belonging to each class is determined for Mel IPSE cepstrums for the "high" range of the fundamental frequency which are clustered in the manner mentioned above. The barycenter vector thus determined represents a code vector for the "high" range of the fundamental frequency, thus obtaining a codebook $CB_H$. A mapping codebook into which the spectrum parameter for the speech data for the "high" range of the fundamental frequency is mapped is then prepared while providing a time alignment for every period waveform and while referring to the result of clustering in the codebook $CB_M$ (reference codebook) for the "middle" range of the fundamental frequency. A procedure similar to that described above in connection with step S211 is used at step S213 to cluster feature quantities (Mel IPSE cepstrums) in the speech data for the "low" range of the fundamental frequency and to determine the barycenter vector for the feature quantities in each class at step S214, thus preparing a codebook $CB_L$ for the "low" range of the fundamental frequency.

It will be seen that at this point, a one-to-one correspondence is established between code vectors having the same code number for three ranges, "high", "middle" and "low", of the fundamental frequency, thus providing three codebooks $CB_L$, $CB_M$ and $CB_H$.

At step S215, a difference between corresponding code vectors of the codebook $CB_H$ for the "high" range and the codebook $CB_M$ for the "middle" range of the fundamental frequency is determined, thus preparing a differential vector codebook $CB_{MH}$. Similarly, at step S216, a difference between corresponding code vectors of the codebook $CB_L$ for the "low" range and the codebook $CB_M$ for the "middle" range of the fundamental frequency is determined, preparing a differential vector codebook $CB_{ML}$.

In the present embodiment, a mean value $F_H$, $F_M$ and $F_L$ of fundamental frequencies associated with element vectors belonging to each class of the respective codebooks $CB_H$, $CB_M$ and $CB_L$ is determined at steps S217, S218 and S219, respectively.

At step S220, a difference $\Delta F_{HM}$ between the mean frequencies $F_H$ and $F_M$, as between corresponding code vectors of the codebooks $CB_H$ and $CB_M$, is determined to prepare a mean frequency difference codebook $CB_{FMH}$. Similarly, at step S221, a difference $\Delta F_{LM}$ between the mean frequencies $F_M$ and $F_L$ as between corresponding code vectors of the codebooks $CB_M$ and $CB_L$ is determined to prepare a mean frequency difference codebook $CB_{FML}$.

Thus it will be seen that five codebooks including the codebook $CB_M$ for the "middle" range of the fundamental frequency, two differential vector codebooks $CB_{MH}$ and $CB_{ML}$ and two mean frequency difference codebooks $CB_{FMH}$ and $CB_{FML}$ are provided in this embodiment.

Now referring to FIG. 6, a processing procedure for the speech synthesis method which applies a modification to the spectrum envelope in accordance with the fundamental frequency while utilizing the five codebooks prepared by the procedure illustrated in FIG. 5 will be described. Inputs to this algorithm are a speech segment waveform selected by a text speech synthesizer, the fundamental frequency $F_{0t}$ of speech which is desired to be synthesized and the fundamental frequency $F_{0u}$ of the speech segment waveform, and the output is a synthesized speech. The processing procedure will be described in detail below.

At step S401, a speech feature quantity, which is IPSE cepstrum in the present example, is extracted from a speech segment which is input by a technique similar to the algorithm described above in connection with steps S201 to S203 shown in FIG. 2. At step S402, the frequency scale of the extracted IPSE cepstrum is converted into Mel scale, thus providing Mel IPSE cepstrum.

At step S403, using the codebook $CB_M$ for the "middle" range of the fundamental frequency which is prepared by the algorithm shown in FIG. 5, the speech feature quantity extracted at step S402 a is fuzzy vector quantized to provide fuzzy membership functions $\mu_k$ for k-nearest neighbors as given by equation ($_2$) below.

$$\mu_k=(1/(\Sigma(d_k/d_j)^{1/(f-1)} \quad (2)$$

where $d_j$ represents a distance between an input vector and a code vector, f a fuzziness and Σ extends from j=1 to j=k. For details of fuzzy vector quantization, see "Normalization of spectrogram by fuzzy vector quantization" by Nakamura and Shikano in Journal of Acoustical Society of Japan, Vol. 45, No. 2 (1989) or A. Ho-Ping Tseng, Michael J. Sabin and Edward A Lee, "Fuzzy Vector Quantazation Applied to Hidden Markov Modeling", Proceedings of IEEE International Conference on Acoustics, Speech, and Signal Processing (ICASSP) Vol. 2, pp. 641–644, April 1987.

At step S404, using the differential vector codebook $CB_{HM}$ or $CB_{HL}$, a weighted synthesis of differential vectors $V_i$ for k-nearest neighbors by fuzzy membership functions $\mu_k$ takes place, providing a differential vector V for the input vector as indicated in equation (3) below.

$$V=\Sigma\mu_j V_j/\Sigma\mu_j \quad (3)$$

where Σ extends from j=1 to k. The codebook $CB_{HM}$ is used when the fundamental frequency $F_{0t}$ of a speech to be synthesized is higher than $F_{0u}$ of the input speech segment while the codebook $CB_{ML}$ is used when the reverse is true. The technique of determining the differential vector V is equivalent to a technique utilizing the so-called moving vector field smoothing as disclosed in "Spectral Mapping for Voice Quality Conversion Using Speaker Selection and Moving Vector Field Smoothing" by Hashimoto and Higuchi in the Institute of Electronics, Information and Communication Engineers of Japan, Technical Report SP95-1 (1995-051) or its counterpart in English, C. Makoto Hashimoto and Norio Higuchi, "Spectral Mapping for Voice Conversion Using Speaker Selection and Vector Field Smoothing", Proceedings of 4th European Conference on Speech Communication and Technology (EUROSPEECH) Vol. 1, pp. 431–434, Sept. 95, section for moving vector field smoothing, for example.

At step S405, the stretching rate r for the differential vector V is determined from equation (4) given below using the fundamental frequency $F_{0u}$ of a speech to be synthesized, the fundamental frequency $F_{0u}$ of the input speech segment and the mean frequency difference codebook $CB_{FMH}$ or $CB_{FML}$ determined according to FIG. 5.

$$r=(F_{0t}-F_{0u})/\Delta F \quad (4)$$

$$\Delta F=\Sigma\mu_j\Delta F_j/\Sigma\mu_j \quad (5)$$

where Σ extends from j=1 to k and $\Delta F_j$ represents the difference of the mean fundamental frequencies of the codebooks $CB_{FMH}$ and $CB_{FML}$.

At step S406, the differential vector V obtained at step S404 is linearly stretched according to the stretching rate r determined at step S405.

At step S407, the differential vector which is linearly stretched at step S406 is added to Mel IPSE cepstrum (input vector) to obtain Mel IPSE cepstrum which is modified in accordance with the fundamental frequency $F_{0t}$ of a speech to be synthesized.

At step S408, the modified IPSE cepstrum is converted in frequency scale from Mel scale to linear scale by Oppenheim's recurrence.

At step S409, the IPSE cepstrum which is converted into the linear scale is subject to the inverse FFT (with zero phase), obtaining a speech waveform having a spectrum envelope which is modified in accordance with $F_{0t}$.

At step S410, the speech waveform obtained at step S409 is passed through a low pass filter, producing a waveform comprising only low frequency components.

At step S411, the speech waveform obtained at step S409 is passed through a high pass filter, extracting only high frequency components. The cut-off frequency of the high pass filter is chosen equal to the cut-off frequency of the low pass filter used in step S410.

At step S412, a Hamming window having a length equal to double the fundamental period and centered about a pitch mark location is applied to the input speech segment to cut out a waveform.

At step S413, the waveform which is cut out at step S412 is passed through the same high pass filter as used at step S411, extracting high frequency components At step S414, a level adjustment is made such that the level of high frequency components in the input waveform which are obtained at step S413 becomes the same level as the high frequency components in the speech waveform having the modified spectrum envelope which is obtained at step S411.

At step S415, the high frequency components having its level adjusted at step S414 are added together with the low frequency components extracted at step S410.

At step S416, the waveform from step S415 is arrayed in alignment with the desired fundamental frequency $F_{0t}$, thus providing a synthesized speech.

Figure 7:
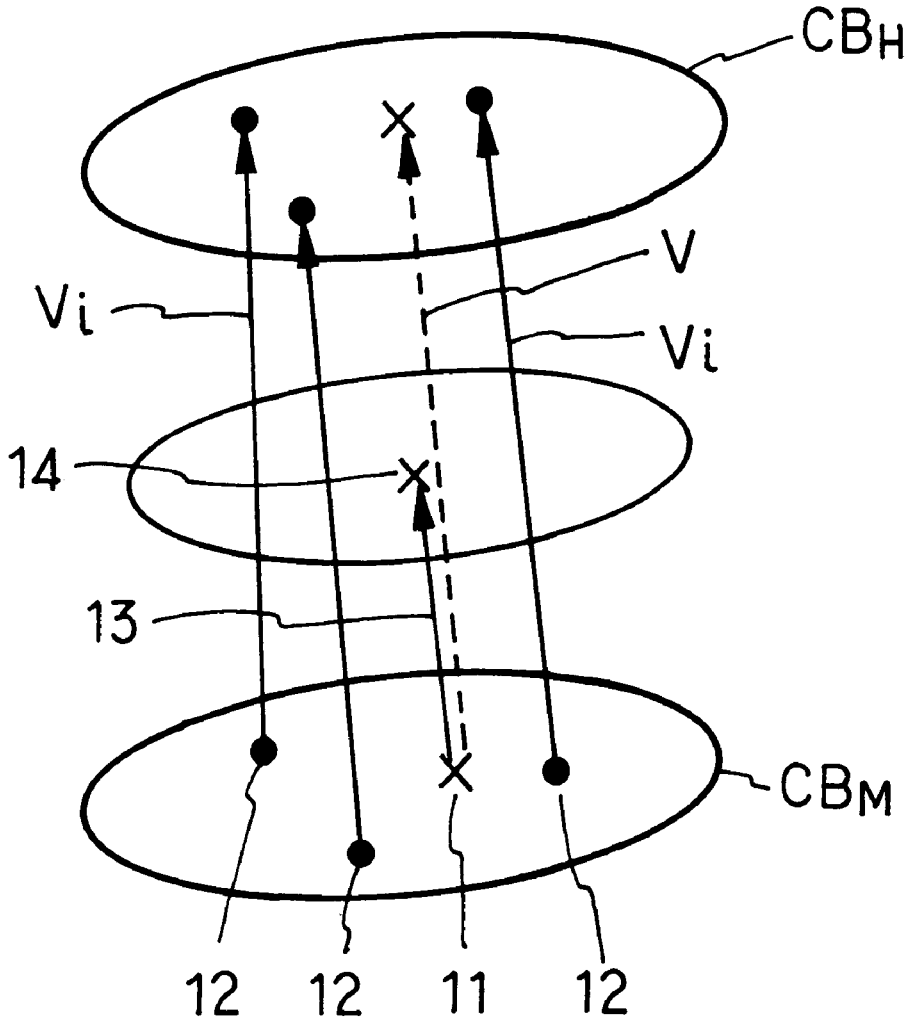
FIG. 7 is an illustration of the concept of modifying the spectrum envelope with the differential vector shown in FIG. 6.

The described procedure of modifying the spectrum envelope is conceptually visualized in FIG. 7 where it will be noted that k-nearest neighbor code vectors 12 are defined for a vector 11 obtained by fuzzy vector quantizing the input vector (Mel IPSE cepstrum obtained at step S402) by the codebook $CB_M$. A differential vector $V_i$ of these vectors with respect to a corresponding one of code vectors in the codebook $CB_H$ is determined by the codebook $CB_{MH}$. The differential vector V against the fuzzy vector quantized vector 11 is determined according to the equation (3). The vector V is linearly stretched in accordance with the stretching rate r defined by the equation (4). The input vector is added to the stretched vector v to yield the modified vector (Mel IPSE cepstrum) 14, which is the intended one.

Figure 8:
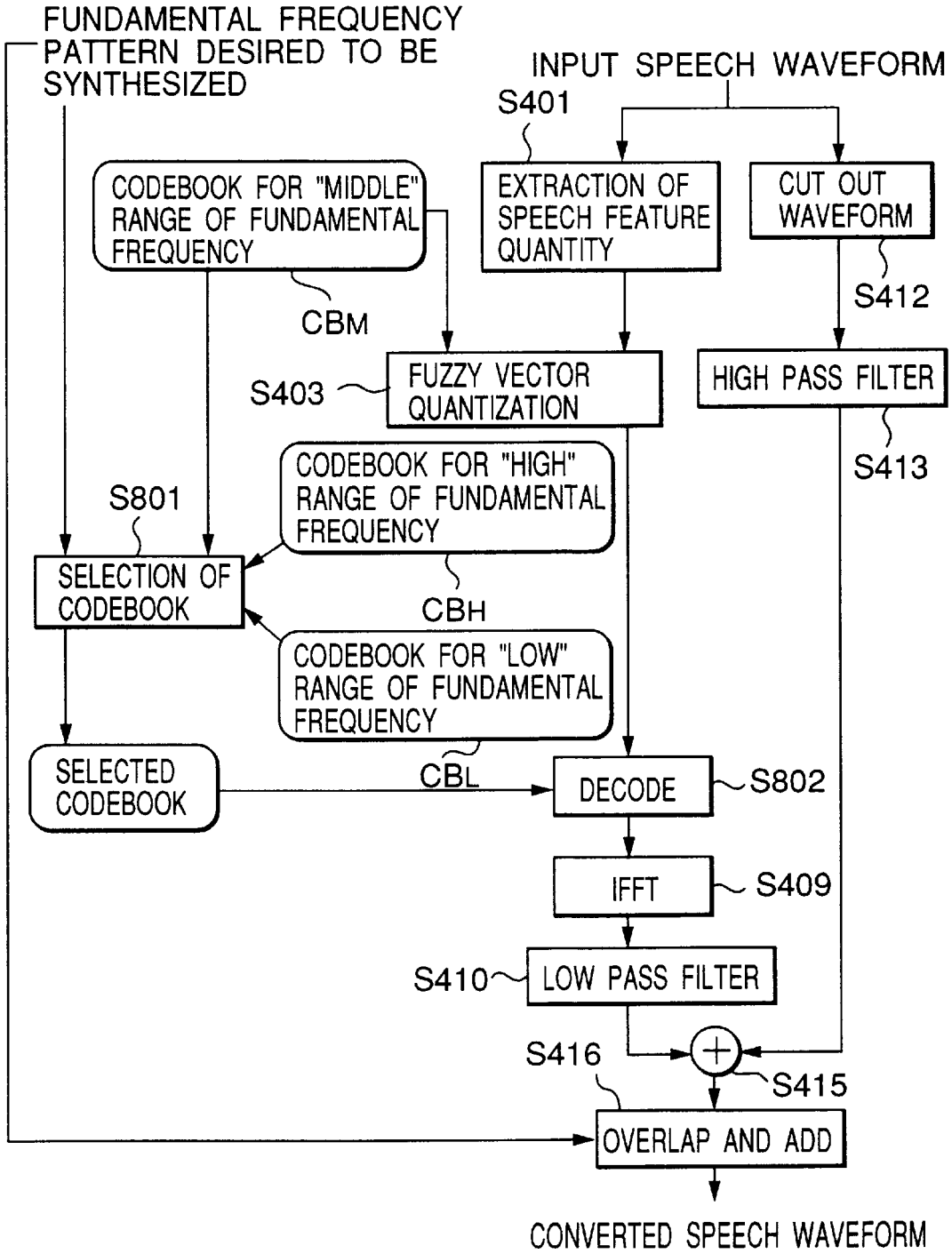
FIG. 8 is a flowchart of an algorithm which modifies the spectrum envelope of a speech segment in accordance with a desired fundamental frequency pattern in another embodiment of the invention.

It is possible to use the codebooks $CB_H$ and $CB_L$ without using the differential vector codebooks $CB_{MH}$ and $CB_{ML}$. Such a variation is illustrated in FIG. 8 where a processing operation similar to that occurring in FIG. 6 is designated by a like step number.

In this instance, Mel scale conversion is not made in order to simplify the processing operation, but may be employed optionally.

At step S801, one of the codebooks for the "high" and "low" ranges of the fundamental frequency which is closest to the frequency of a speech to be synthesized is selected.

At step S802, using the codebook $CB_H$ for the "high" range, for example, which is selected at step S801, the speech feature quantity which is fuzzy vector quantized at step S403 is decoded.

At step S409, the vector (speech feature quantity) which is decoded at step S802 is subject to the inverse FFT process, thus obtaining a speech waveform.

At step S410, the speech waveform obtained at step S409 is passed through a low pass filter, yielding a waveform comprising only low frequency components.

Figure 6:
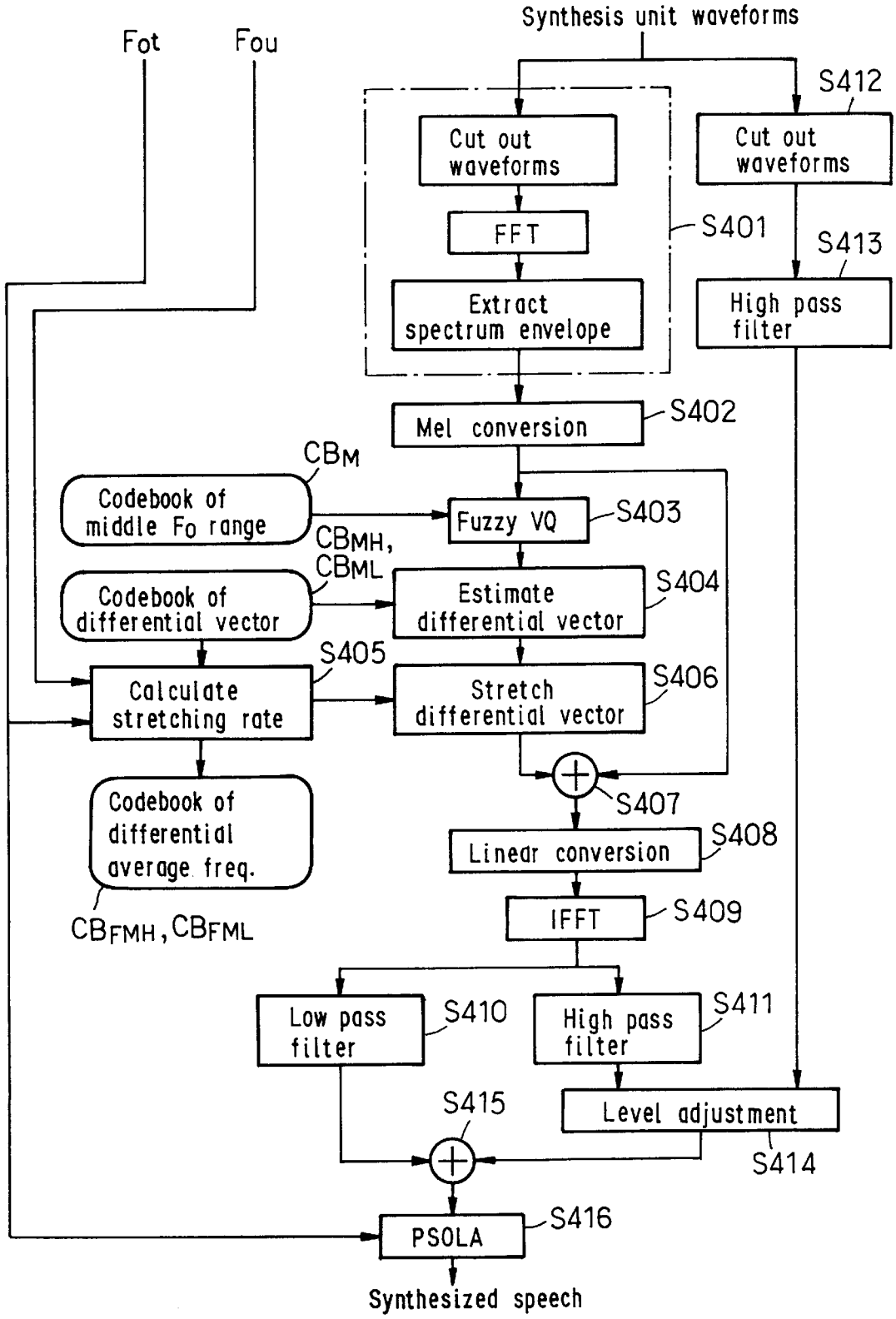
FIG. 6 is a flowchart of an algorithm which modifies the spectrum envelope of a speech segment in accordance with a desired fundamental frequency pattern in the embodiment of the invention.

This example exemplifies an omission or simplification of steps S411 and S414 shown in FIG. 6. The waveform comprising only the low frequency components as obtained at step S410 and the waveform comprising only the high frequency components as obtained at step S413 are added together at step S415. The subsequent processing operation remains the same as shown in FIG. 6. The technique of modifying the speech quality by extracting a code vector, which corresponds to a code vector in one codebook $CB_M$, from a different codebook $CB_H$ is disclosed, for example, in H. Matsumoto "A Minimum Distortion Spectral Mapping Applied to Voice Quality Conversion" ICSLP 90 pp. 161–164.

In the speech synthesis algorithm shown in FIG. 8, in place of fuzzy vector quantizing the speech feature quantity at step S403, an alternative process may be employed comprising vector quantizing the speech data for the "middle" range of the fundamental frequency using the codebook for the "middle" range of the fundamental frequency by utilizing the moving vector field smoothing technique, followed by determining a moving vector to the codebook for the range of the fundamental frequency which is desired to be synthesized and decoding in the range moved.

The processing operation which takes place at step S403 is not limited to a fuzzy vector quantization or an acquisition of a moving vector to an intended codebook according to the moving vector field smoothing technique, but a single input feature quantity may be quantized as a single vector code in the similar manner as occurs in a usual vector quantization. However, as compared with this usual process, the use of the fuzzy vector quantization or the moving vector field smoothing technique provides a more excellent continuity of the time domain signal which is obtained at step S416.

Alternatively, the extraction of low frequency components by the use of a low pass filter at step S410 may extract those components in the difference between the fundamental frequency pattern of the input speech segment and the fundamental frequency pattern which is desired to be synthesized which do have an influence upon the spectrum envelope. Conversely, the high pass filter used at step S413 may extract high frequency components for which the difference in the fundamental frequency pattern has little influence upon the spectrum envelope. A boundary frequency between the low frequency components and the high frequency components is chosen to be on the order of 500 to 2000 Hz.

As a further alternative, the input speech waveform may be divided into high and low frequency components, which may then be delivered to steps S401 and S412, respectively, shown in FIG. 6 or 8.

In the foregoing description, the invention is applied to achieve a matching between the fundamental frequency and the spectrum of the synthesized speech where there is a large deviation between input speech segments and the input fundamental frequency pattern in the text synthesis. However, the invention is not limited to such use, but is also applicable to the synthesis of a waveform in general. In addition, in the analysis and synthesis, where it is intended that the fundamental frequency of a synthesized speech relatively significantly deviates from the fundamental frequency of an original speech which is subjected to the analysis, the application of the invention allows a synthesized speech of good quality to be obtained. In such instance, an original speech may be used as an input voice waveform in FIG. 6, and the codebook for the "middle" range of the fundamental frequency or the reference codebook may be prepared for the range of the fundamental frequency which is applicable to the original speech by a technique similar to one described previously.

In the analysis and synthesis, the original speech corresponds to the input speech segment (input speech waveform), and is normally quantized as a vector code of a feature quantity and then decoded for speech synthesis. Accordingly, where the invention is applied to the analysis and speech, in an arrangement as shown in FIG. 8, for example, using a codebook which depends on the fundamental frequency of synthesized speech, the vector code may be decoded at step S802. To apply the procedure shown in FIG. 6 to the synthesis and analysis, a vector code and a differential vector which corresponds to the vector code of speech to be synthesized may be obtained from the codebook $CB_M$ and the differential vector codebook $CB_{MH}$ or $CB_{ML}$, respectively, a stretching rate may be determined in accordance with a difference between the fundamental frequency of the original speech and the fundamental frequency of a speech to be synthesized, the differential vector obtained may be stretched in accordance with the stretching rate, and the stretched differential vector may be added to the code vector obtained above.

Each of the speech synthesis processing operation is usually performed by decoding and executing a program as by a digital signal processor (DSP). Thus, a program used at this end is recorded in a record medium.

A listening test conducted when the invention is applied to the text synthesis will be described. 520 ATR phoneme-balanced words were uttered by a female speaker in three pitch ranges of "high", "middle" and "low". Of these, 327 utterances are used for each pitch in preparing codebooks, and 74 utterances are used to provide evaluation data in the test. The test was conducted under the conditions of a sampling frequency of 12 KHZ, a band separation frequency of 500 Hz (which is equivalent to a cut-off frequency of a filter used in steps S410, S411 and S413), a codebook size of 512, the orders of cepstrums of 30 (which represent feature quantities obtained by the procedure shown in FIG. 2), the number of k-neighbors of 12 and a fuzziness of 1.5.

Figure 9A:
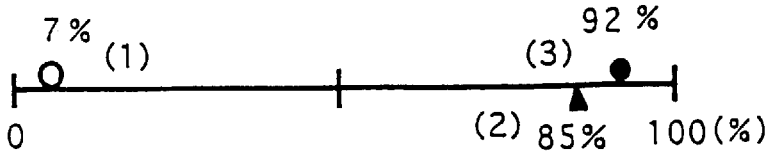
FIGS. 9A and B are depictions of results of experiments which demonstrate the effect brought forth by the embodiment shown in FIG. 6.

To evaluate if the modification of the spectrum envelope through the code mapping is effective in improving the quality of the synthesized speech, a listening test is conducted for a speech having its fundamental frequency modified. Three types of synthesized speeches for five words are evaluated according to the ABX method, including synthesized speech (1), representing the prior art, in which the fundamental frequency pattern of a natural speech B which is of the same text as, but which has a different range of he fundamental frequency from a natural speech A is modified into the natural speech A by the conventional PSOLA method, a correct solution speech (natural speech A) (2) and a synthesized speech (3) in which the fundamental frequency pattern of the natural speech B is modified into that of the natural speech A by the procedure shown in FIG. 6. Synthesized speeches (1) and (3) are elected as A and B, respectively, while synthesized speeches (1), (2) and (3) are used as X, and test subjects are required to determine to which one of A and B X is found to be closer. The modification of the fundamental frequency pattern took place from the middle pitch (mean fundamental frequency of 216 Hz) to the low pitch (mean fundamental frequency of 172 Hz) and from the middle pitch to the high pitch (mean fundamental frequency of 310 Hz), by interchanging the fundamental frequency patterns of speeches for the same word in different pitch ranges. The stretching rate r of the differential vector is fixed to 1.0, and the power and the duration of vocal sound are aligned to those of words to which the fundamental frequency is modified. There were twelve test subjects. A decision rate CR (CR=Pj/Pa*100(%)) is determined from results of the listening test. Pj represents the number of times X is found closer to the synthetic speech (3) while Pa the number of trials. FIGS. 9A and B shows the results obtained.

FIG. 9A shows the result for a conversion from the middle to the low pitch. In view of the facts that the decision rate for the natural speech (2) is equal to 85% while the corresponding decision rate is equal to 59% for a conversion from the middle to the high pitch, it is seen that the present invention enables the synthesis of a speech having its fundamental frequency modified in a manner closer to a natural speech than when the conventional PSOLA method is used. It is also seen that the invention is very effective for converting the fundamental frequency down.

Figure 10A:
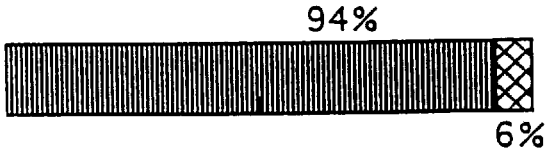
FIGS. 10A, B and C are similar depictions of results of other experiments which also demonstrate the effect brought forth by the embodiment shown in FIG. 6.
Figure 10B:
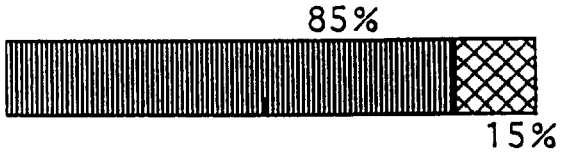
Figure 10C:
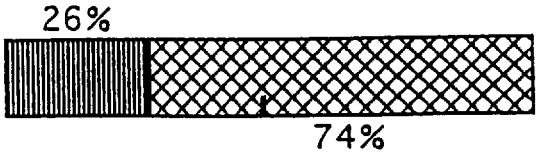

The procedure shown in FIG. 6 is compared against the conventional PSOLA method as applied to the text speech synthesis. Five sentences chosen from 503 ATR phoneme balanced sentences are synthesized in three pitch ranges, "low", "middle" and "high", and are evaluated in a preference test. To avoid the influence of the unnaturalness of a pitch pattern which is determined by rule upon the test, a pitch pattern extracted from a natural speech is employed as the fundamental frequency pattern for the "middle" pitch. Pitch patterns for the "high" pitch and the "low" pitch are prepared by raising and lowering the pitch range, respectively, and are then used in the analysis. The codebook used in modifying the spectrum envelope remains the same as used in the test mentioned above, and the test is conducted under the same conditions as before. FIGS. 10A, B and C show results of the test, with FIG. 10A for the low pitch range, FIG. 10B for the middle pitch range and FIG. 10C for the high pitch range. It is seen from these results that for synthesized speeches in the "low" and the "middle" pitch range, the test subjects prefer the outcome of the procedure of the invention to the PSOLA method.

Figure 11A:
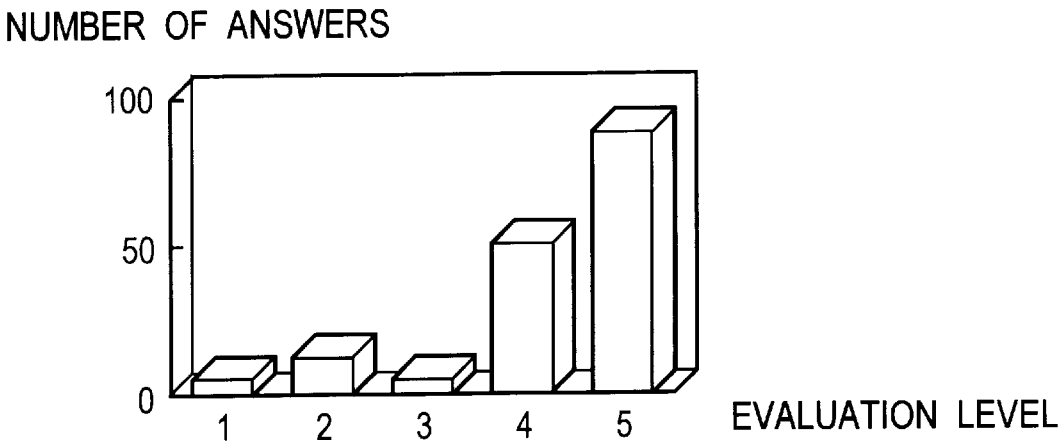
FIGS. 11A, B and C are similar depictions of results of experiments which demonstrate the effect brought forth by the embodiment shown in FIG. 8.

A listening test for the procedure of the invention illustrated in FIG. 8 in comparison to the conventional (PSOLA) method will be described. Test conditions remain the same as mentioned above except that the band separation frequency is chosen to be 1500 Hz. In a comparative test between the speech having the fundamental frequency modified by synthesis according to the conventional waveform synthesis technique and a corresponding speech modified according to the procedure of the invention in a listening test, an input comprised a spectrum envelope which is extracted from a word to which a fundamental frequency pattern is modified (i.e. correct solution spectrum envelope) on the assumption that a modification of the low band spectrum envelope (IPSE) is achieved in a perfect manner, in order to allow an investigation into the maximum potential capability of the procedure of the invention. A modification of the fundamental frequency pattern takes place from the high pitch to the low pitch and also from the low pitch to the high pitch, by interchanging the fundamental frequency patterns of the same word in different pitch ranges. The power and the duration of vocal sound are aligned to those of words to which $F_0$ is modified. Evaluation is made for five words in terms of a relative comparison of superiority/inferiority in five levels from eight test subjects. The test result is shown in FIG. 11A. It will be seen from this Figure that the synthesized speech according to the procedure of the invention provides a quality which significantly excels the quality of synthesized speech from the conventional waveform synthesis.

In FIG. 11A, evalutaion 1 indicates a finding that the conventional waveform synthesis works much better, evaluation 2 that the conventional waveform synthesis works slightly better, evaluation 3 that there is no difference, evaluation 4 that the procedure of the invention works slightly better, and evaluation 5 that the procedure of the invention works much better.

Figure 9B:
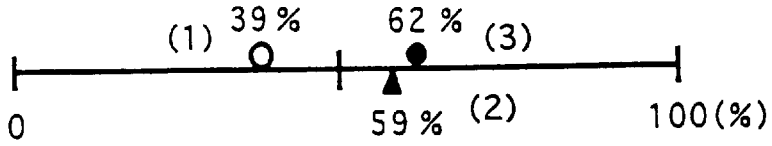
Figure 11B:
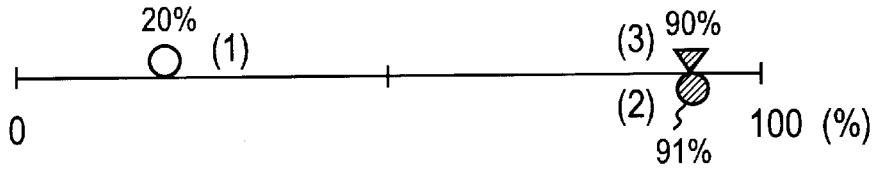
Figure 11C:
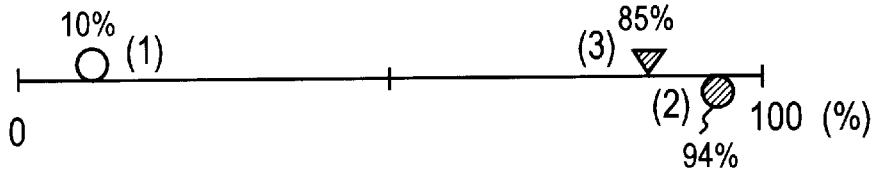

A test similar to that described above in connection FIG. 9 has been conducted under the same conditions as before except that the band separation frequency is now chosen to be 1500 Hz. FIGS. 11B and C illustrate test results for a modification from the middle to the low pitch and a modification from the middle to the high pitch, respectively.

The decision rates for the synthesized speeches (1) and (2) are 21% and 91%, respectively, for the modification of the fundamental frequency from the middle to the low pitch, and 10% and 94%, respectively, for the modification from the middle to the high pitch. The decision rate for the synthesized speech (3) is 90% and 85% for the modifications from the middle to the low pitch and from the middle to the high pitch, respectively, indicating that the low band spectrum envelope is properly modified by the codebook mapping. Considering this together with the results shown in FIG. 10A, it will be seen that as compared with the conventional waveform synthesis, the speech synthesis method of the invention enables the synthesis of a speech of higher quality which has its fundamental frequency modified.

From the foregoing, it will be understood that a quality degradation of synthesized speech which is attributable to a significant modification of the fundamental frequency pattern of speech segments during the synthesis in a text speech synthesis system, for example, can be prevented in accordance with the invention. As a consequence, a speech of a higher quality can be synthesized as compared with a conventional text speech synthesis system. Also, in the analysis and synthesis, a synthesized speech of a high quality can be obtained if the fundamental frequency relatively significantly deviates from the original speech. In other words, while a variety of modifications of the fundamental frequency pattern are required in order to synthesize more humanlike or emotionally enriched speech, the synthesis of such speech to a high quality is made possible by the invention.

What is claimed is:

1. A speech synthesis system which synthesizes a speech in a desired fundamental frequency distinct from the fundamental frequency of an input speech, comprising a reference codebook prepared by clustering the spectrum envelope of a learning speech data in the same range of the fundamental frequency as the input speech by a statistical technique, a codebook for a different range of the fundamental frequency from the input speech, the codebook being prepared from a learning speech data for the same text as the learning speech data initially mentioned in a manner to exhibit a correspondence to code vectors in the reference codebook, a differential vector codebook comprising differential vectors between corresponding code vectors of the reference codebook and a codebook for a different range, a frequency difference codebook comprising differences of mean values of the fundamental frequency of element vectors in each corresponding class between the reference codebook and the codebook for the different range, quantizing means for vector quantizing the spectrum envelope of the input speech using the reference codebook, differential vector evaluation means for determining a differential vector which corresponds to the quantized code using the diffential vector codebook, means for calculating a stretching rate on the basis of the fundamental frequency of the input speech, the desired fundamental frequency and the frequency difference which corresponds to the quantized code and which is determined from the frequency difference codebook, stretching means for stretching the differential vector in accordance with the stretching rate, means for adding the stretched differential vector and the spectrum envelope of the input speech together, and means for transforming the added spectrum envelope into the time domain.

2. A speech synthesis system according to claim 1 in which the quantizing means comprises fuzzy vector quantizing means; the differential vector evaluation means comprises means to determine the differential vector by a weighted synthesis by a fuzzy membership function of the differential vectors from the differential vector codebooks associated with k-nearest-neightbors determined during the fuzzy vector quantization; and said means for calculating a stretching rate comprises means to determine a stretching rate by a weighted synthesis by a fuzzy membership function of frequency differences from the frequency difference codebooks which correspond to the k-nearest-neighbors and by a division of a difference between the both fundamental frequencies by the resulting synthesized frequency difference.

3. A speech synthesis system according to claim 1 or 2, further comprising a low pass filter for extracting low band components of the signal transformed into the time domain, a high pass filter for extracting high band components of the input speech signal, the high pass filter having the same cut-off frequency as the low pass filter, and means for adding outputs from the low pass and the high pass filter together.

4. A record medium having recorded therein a program for a procedure in which synthesizes a speech in a desired fundamental frequency distinct from the fundamental frequency of an input speech to thereby synthesize a speech, in which the input speech is vector quantized using a reference codebook for a range of the fundamental frequency which corresponds to the input speech; a differential vector which corresponds to the quantized vector is determined from a differential vector codebook for a range of the fundamental frequency which corresponds to the desired fundamental frequency; the differential vector is stretched in accordance with a difference between the fundamental frequency of the input speech and the desired fundamental frequency; the stretched differential vector and the spectrum envelope of the input speech are added together; and the added spectrum envelope is transformed into a signal in the time domain, thereby yielding speech segments which have undergone a modification to the spectrum envelope.

5. A record medium according to claim 4 in which the vector quantization comprises a fuzzy vector quantization; a differential vector which corresponds to one of k-nearest-neighbors during the fuzzy vector quantization is determined from the differential vector codebook; and the differential vector initially mentioned is provided by a weighted synthesis of these differential vectors according to a fuzzy membership function used in the fuzzy vector quantization.

6. A record medium according to claim 5 in which frequency differences corresponding to k-nearest-neighbors are determined from a frequency difference codebook and are then subject to a weighted synthesis according the fuzzy membership function, and the synthesized frequency difference is used to divide a difference between the both fundamental frequencies to determine a stretching rate, the differential vector being stretched in accordance with the stretching rate.

7. A record medium according to one of claims 4 to 6 in which a logarithmic power spectrum is sampled for a maximum value which is located adjacent to an integral multiple of the fundamental frequency; an interpolation is made between sampling points with a rectilinear line; the linear pattern is sampled at an equal interval; a resulting series of samples are approximated by a cosine model, the model having coefficients which provide a feature quantity representing the spectrum envelope.

8. A speech synthesis method for synthesizing a speech in a desired fundamental frequency distinct from the fundamental frequency of an input speech, comprising the steps of:

(a) previously establishing a relationship between a fundamental frequency and a spectrum envelope for each of different frequency ranges of learning speech data produced by a same speaker;

(b) selecting one of the relationships between the fundamental frequency and the spectrum envelope in accordance with a deviation of said desired fundamental frequency from the fundamental frequency of the input speech; and (c) applying a modification to the spectrum envelope of the input speech by using the selected one of the relationships between the fundamental frequency and the spectrum envelope.

9. A speech synthesis method which in a desired fundamental frequency distinct from the fundamental frequency of an input speech synthesizes a speech, comprising the steps of:

(a) previously establishing relationships between fundamental frequencies and spectrum envelopes from learning speech data in different ranges of fundamental frequency;

(b) selecting one of the relationships between the fundamental frequencies and the spectrum envelopes in accordance with a deviation of the desired fundamental frequency from the fundamental frequency of the input speech;

(c) applying a modification to the spectrum envelope of the input speech by using the selected one of the relationships between the fundamental frequencies and the spectrum envelopes;

wherein said step (a) comprises a step of establishing the relationships between the fundamental frequencies and spectrum envelopes as differential vector codebooks which comprise differential vectors between corresponding code vectors of a reference codebook which is provided as a codebook for one of the ranges of the fundamental frequency for the input speech and another codebook for one of the other ranges of the fundamental frequency;

said step (c) comprising the steps of:

(c-1) vector quantizing the input speech using the codebook for the fundamental frequency of the input speech;

(c-2) determining a differential vector which corresponds to the vector quantized code from the different vector codebook;

(c-3) stretching the differential vector in accordance with the deviation of the desired fundamental frequency; and (c-4) adding the stretched differential vector to the vector for the vector quantized code to provide a modification of the spectrum envelope.

10. A speech synthesis method which, in a desired fundamental frequency distinct from the fundamental frequency of an input speech, synthesizes a speech, comprising the steps of:

(a) previously establishing relationships between fundamental frequencies and spectrum envelopes from a learning speech data in different ranges of fundamental frequency;

(b) selecting one of the relationships between the fundamental frequencies and the spectrum envelopes in accordance with a deviation of the desired fundamental frequency from the fundamental frequency of the input speech;

(c) applying a modification to the spectrum envelope of the input speech by using the selected one of the relationships between the fundamental frequencies and the spectrum envelopes;

wherein said step (a) includes the step of establishing the relationships between the fundamental frequencies and the spectrum envelopes as codebooks which are prepared for each range of the fundamental frequency to provide a correspondence between respective code vectors; and said step (c) comprises the steps of:

(c-1) vector quantizing the input speech using one of the codebooks which corresponds to the fundamental frequency of the input speech; and (c-2) decoding the quantized vector with the codebook for the desired range of the fundamental frequency, thus providing a modification of the spectrum envelope;

step (a) further comprising the steps of:

(a-1) clustering the spectrum envelope of a learning speech data in the same range of the fundamental frequency as the input speech by a statistical technique to prepare a reference codebook;

(a-2) performing a linear stretch matching on the time axis for a pitch mark present in each voiced phoneme in a common text between a learning speech data in a range of the fundamental frequency different from the input speech and a learning speech data in the same range of the fundamental frequency as the input speech to achieve a time alignment for every one period waveform; and (a-3) preparing a codebook for a range of the fundamental frequency which is different from the input speech while referring to a result of clustering in the reference codebook.

11. A speech synthesis method which, in a desired fundamental frequency distinct from the fundamental frequency of an input speech, synthesizes a speech, comprising the steps of:

(a) previously establishing relationships between fundamental frequencies and spectrum envelopes from a learning speech data in different ranges of fundamental frequency;

(b) selecting one of the relationships between the fundamental frequencies and the spectrum envelopes in accordance with a deviation of the desired fundamental frequency from the fundamental frequency of the input speech;

(c) applying a modification to the spectrum envelope of the input speech by using the selected one of the relationships between the fundamental frequencies and the spectrum envelopes;

wherein said step (a) includes a step of establishing the relationships between the fundamental frequencies and the spectrum envelopes as codebooks which are prepared for three ranges of the fundamental frequency including "high", "middle" and "low" ranges to provide a correspondence between respective code vectors; and said step (c) comprises the steps of:

(c-1) vector quantizing the input speech using one of the codebooks which corresponds to the fundamental frequency of the input speech; and (c-2) decoding the quantized vector with the codebook for the desired range of the fundamental frequency, thus providing a modification of the spectrum envelope;

wherein said step (a) further comprises the steps of:

(a-1) sampling a logarithmic power spectrum for a maximum value which is located adjacent to an integral multiple of the fundamental frequency;

(a-2) interpolating between sampling points with a rectilinear line;

(a-3) sampling the interpolated linear pattern at an equal interval; and (a-4) approximating a series of samples by a cosine model, coefficients of said cosine model being used as the spectrum envelope.

12. A speech synthesis method according to claims 8 or 10, wherein said step (a) includes a step of establishing the relationships between the fundamental frequencies and the spectrum envelopes as codebooks which are prepared for each range of the fundamental frequency to provide a correspondence between respective code vectors; and said step (c) comprises the steps of:

(c-1) vector-quantizing the input speech using one of the codebooks which corresponds to the fundamental frequency of the input speech; and (c-2) decoding the quantized vector with the codebook for the desired range of the fundamental frequency, thus providing a modification of the spectrum envelope.

13. A speech synthesis method according to claims 10 or 11, in which the vector quantization comprises a fuzzy vector quantization.

14. A speech synthesis method according to claim 9, wherein said step (a) comprises a step of preparing a frequency difference codebook comprising differences of mean values of the fundamental frequency in each corresponding class between the reference codebook and codebooks for other ranges of the fundamental frequency;

said step (c-2) comprises a step of determining a frequency difference which corresponds to the vector quantized code from the frequency difference codebook; and said step (c-3) comprises a step of normalizing the deviation by the frequency difference to stretch in accordance with the deviation.

15. A speech synthesis method according to claim 9, wherein said step (c-1) of quantizing the input speech comprises a fuzzy vector quantization of said input speech and said step (c-2) comprises a step of determining the differential vector from a weighted synthesis by a fuzzy membership function of the differential vector with k-nearest-neighbors during the fuzzy vector quantization.

16. A speech synthesis method according to any one of claims 9, 14, and 15, wherein said step (a) comprises steps of:

(a-1) clustering the spectrum envelope of learning speech data in the same range of the fundamental frequency as the input speech by a statistical technique to prepare a reference codebook;

(a-2) performing a linear stretch matching on the time axis for a pitch mark present in each voiced phoneme in a common text between learning speech data in a range of the fundamental frequency different from the input speech and learning speech data in the same range of the fundamental frequency as the input speech to achieve a time alignment for every one period waveform; and (a-3) preparing a codebook for a range of the fundamental frequency which is different from the input speech while referring to a result of clustering in the reference codebook.

17. A speech synthesis method according to any one of claims 9, 14, and 15, wherein said step (a) comprises the steps of:

(a-1) sampling a logarithmic power spectrum for a maximum value which is located adjacent to an integral multiple of the fundamental frequency;

(a-2) interpolating between sampling points with a rectilinear line;

(a-3) sampling the interpolated linear pattern at an equal interval; and (a-4) approximating a series of samples by a cosine model, coefficients of said cosine model being used as the spectrum envelope.

18. A speech synthesis method according to any one of claims 8, 9, 14, and 15, wherein in said step (c) the modification of the spectrum envelope is applied only to components in a band lower than a given frequency in a spectral region.

19. A speech synthesis method according to claim 18, wherein said step (c) comprises the steps of:

(c-1) applying the modification of the spectrum envelope over the entire band of the input speech;

(c-2) separating a signal resulted from the application of the modification to the spectrum envelope being separated into lower band components and higher band components;

(c-3) adjusting the level of high band components in said input speech to the level of said higher band components obtained in said step (c-2) to produce adjusted high band components; and (c-4) adding said adjusted high band components of the input speech and said lower band components together, thus providing a modification in which only the lower band components are modified.

20. A speech synthesis method according to any one of claims 8, 9, 14, and 15, wherein in said step (c) the spectrum envelope of the input speech is converted into Mel scale before being subject to the modification, and a result of the modification of the spectrum envelope is converted into a linear scale.

21. A speech synthesis method according to any one of claims 9, 14, and 15, wherein said codebooks are prepared for three ranges of the fundamental frequency including "high", "middle" and "low" ranges.

22. A speech synthesis system which synthesizes a speech in a desired fundamental frequency distinct from the fundamental frequency of an input speech, comprising:

a reference codebook prepared by clustering the spectrum envelope of learning speech data in the same range of the fundamental frequency as the input speech by a statistical technique;

a codebook for a different range of the fundamental frequency from the input speech, the codebook being prepared from learning speech data for the same text as the learning speech data initially mentioned in a manner to exhibit a correspondence to code vectors in the reference codebook;

quantizing means for vector quantizing the spectrum envelope of the input speech using the reference codebook; and decoding means for decoding the quantized code using a codebook for a range of the fundamental frequency which corresponds to the desired fundamental frequency.

23. A recording medium having recorded therein a program for a procedure which synthesizes a speech in a desired fundamental frequency distinct from the fundamental frequency of an input speech to thereby synthesize a speech, in which the input speech is vector quantized using a reference codebook for a spectrum envelope of a fundamental frequency which corresponds to the fundamental frequency of the input speech, and the vector quantized code is decoded with reference to a codebook which corresponds to the desired fundamental frequency and which comprises code vectors having a correspondence to the reference codebook, thereby yielding speech segments which have undergone a modification to the spectrum envelope.

* * * * *